US006478651B1

(12) United States Patent
Weir

(10) Patent No.: US 6,478,651 B1
(45) Date of Patent: Nov. 12, 2002

(54) INFLATABLE BALLOON BOUQUET

(76) Inventor: Steven A. Weir, 2211 Shady Park Dr., Arlington, TX (US) 76013

( * ) Notice: Subject to any disclaimer, the term of this patent is extended or adjusted under 35 U.S.C. 154(b) by 0 days.

(21) Appl. No.: 09/724,483

(22) Filed: Nov. 28, 2000

Related U.S. Application Data

(60) Provisional application No. 60/167,647, filed on Nov. 29, 1999.

(51) Int. Cl.[7] ..... G09F 15/00

(52) U.S. Cl. ..... 446/220; 40/212; 40/538

(58) Field of Search ..... 446/220, 221, 446/222, 223, 224, 225, 226; 40/212, 214, 538

(56) References Cited

U.S. PATENT DOCUMENTS 3,892,081 A * 7/1975 Goral ..... 40/212
4,811,841 A * 3/1989 Domenichiello ..... 206/423
5,023,118 A * 6/1991 Cheng ..... 446/220
5,125,177 A * 6/1992 Colting ..... 446/226
5,293,707 A * 3/1994 Shaeffer ..... 40/214
5,778,581 A * 7/1998 Bailey ..... 446/220

* cited by examiner

*Primary Examiner*—Jacob K. Ackun
(74) *Attorney, Agent, or Firm*—George L. Williamson

(57) ABSTRACT

The present invention discloses a flower vase containing an inflatable balloon bouquet. The flower vase contains a source of air for inflating the balloons positioned near the bottom of the vase being connected to an upwardly standing air cylinder whereby the balloon bouquet stems are pushed upwardly through the air cylinder somewhat as an internal combustion piston passing through its cylinder. Means are provided for transferring gas from the gas canister through apertures in the wall of the air cylinder and thereafter through apertures in the hollow stems of the balloons and thereafter into the balloons themselves so that the balloons become inflated.

13 Claims, 2 Drawing Sheets

INFLATABLE BALLOON BOUQUET

This application claims benefit of Provisional Application Ser. No. 60/167,647 filed on Nov. 29, 1999.

BACKGROUND OF THE INVENTION

1. Field of the Invention

The present invention relates generally to flower vases and bouquets and, more particularly, is concerned with a flower vase containing an inflatable balloon bouquet.

2. Description of the Prior Art

Mechanized flower bouquets have been described in the prior art. However, none of the prior art devices disclose the unique features of the present invention.

In U.S. Pat. No. Des. 327,662, dated Jul. 7, 1992, Cheng disclosed the ornamental design for an inflatable bouquet, as shown.

In U.S. Pat. No. 4,811,841, dated Mar. 14, 1989, Domenichiello disclosed a device and method of constructing articles of fresh cut parts of plants and artificial decorative embodiments. The packaging is characterized by enveloping such articles with an inflated balloon. The article being placed in an open container, a balloon is then inflated and receives the article and container and is then securely attached to the container, thereby enclosing the article. A device for constructing the packaged article employs a rigid conduit which is received in the balloon to facilitate reception of the article and container. The gas used to inflate the balloons can be air or nitrogen. If cut flowers are used, the container is provided with some water and plant food.

In U.S. Pat. No. 5,564,575, dated Oct. 15, 1996, Casement disclosed a balloon sculpturing apparatus which includes a support and a plurality of inverted receptacles with balloon receiving cavities disposed about the support. Balloons filled with lighter than air gas are retained by buoyance in the balloon receiving cavities of the inverted receptacles. The balloon sculpturing apparatus produces a consistent bouquet in a time efficient manner.

In U.S. Pat. No. 5,509,540, dated Apr. 23, 1996, Pomerantz disclosed an invention which related to a holder for balloons, flowers or the like on sticks, comprising a holder element having a mounting surface adapted to be securely attached to a support structure by attachment element located on the mounting surface. At least one receptacle of predetermined depth is adapted to tightly hold a lower portion of the stick by a secure element located within the receptacle, wherein the secure means adapted to securely hold a stick of various diameters. The mounting surface is adapted to be securely attached to a vertical wall or fixture, and wherein a longitudinal centerline of the receptacle is tilted away from the mounting surface to provide less displacement and reduction of bending moment of an upper end of a stick having a balloon or flower attached, which in turn allows reduction of the peeling force applied to the attachment elements. The angle between the longitudinal centerline of the receptacle and the mounting surface is at least ½ degree. The holder element having a number of receptacles adapted to securely hold a plumage-type arrangements of balloons or flowers. The secure elements is provided by means of tapering of the receptacle downwardly from an entrance towards a bottom portion, wherein the receptacle becomes progressively tighter as the stick is further inserted inside of the receptacle.

In U.S. Pat. No. 5,769,685, dated Jun. 23, 1998, Nakamura, et al., disclosed a decorative balloon assembly including a number of connected balloon units. Each balloon unit includes a number of globe-shaped balloon elements arranged in an annular fashion. Each of the balloon elements is linked to adjacent balloon elements by air passageways. One of the balloon elements includes an air inlet valve for inflating the balloon elements. Flexible sheet material connects the balloon elements in the center of the annular arrangement. The flexible sheet includes a center opening through which a connector may be inserted to link a number of balloon units. The connector may be a rod, so that a rigid standing balloon assembly may be constructed. Alternatively, the connector may be a rope, so that the balloon assembly may take a flexible shape, such as an arch to be hung from a ceiling.

While these mechanized flower vases and/or bouquets may be suitable for the purposes for which they were designed, they would not be as suitable for the purposes of the present invention, as hereinafter described.

SUMMARY OF THE INVENTION

The present invention discloses a flower vase containing an inflatable balloon bouquet. The flower vase contains a source of air for inflating the balloons positioned near the bottom of the vase being connected to an upwardly standing air cylinder whereby the balloon bouquet stems are pushed upwardly through the air cylinder somewhat as an internal combustion piston passing through its cylinder. Means are provided for transferring gas from the gas canister through apertures in the wall of the air cylinder and thereafter through apertures in the hollow stems of the balloons and thereafter into the balloons themselves so that the balloons become inflated.

An object of the present invention is to provide a unique way to send a balloon bouquet in a small, self-contained package. A further object of the present invention is to reduce the cost of delivering the flower or balloon bouquet. A further object of the present invention is to provide a simple and inexpensive means for providing the balloon bouquet.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
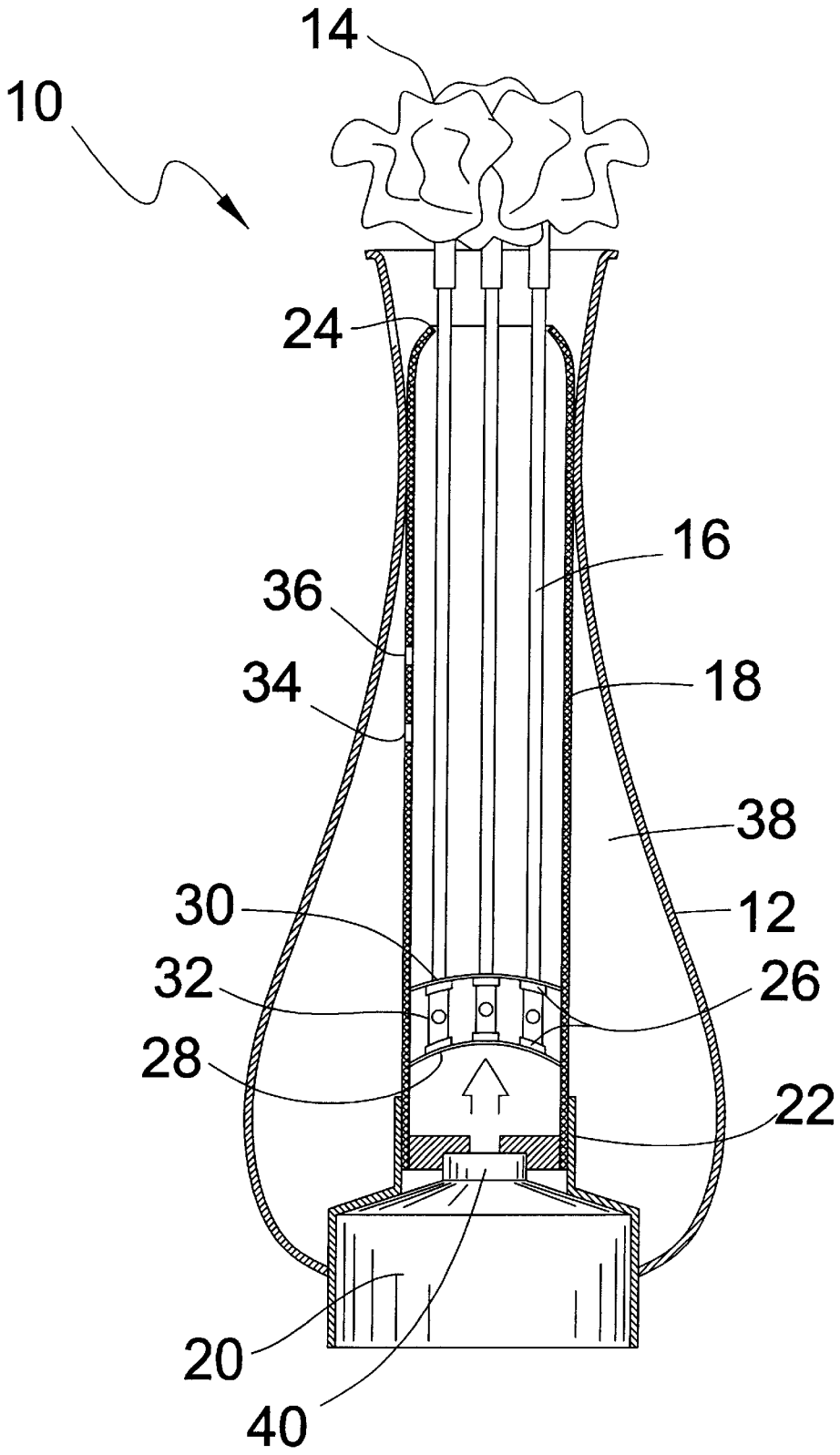
FIG. 1 is a perspective view of the present invention in an uninflated position.

With regard to reference numerals used, the following numbering is used the drawings.

10 present invention
12 vase
14 balloon bouquet
16 stems
18 airshaft
20 air canister
22 means for connection
24 upper air shaft seal
26 apertures
28 lower gasket
30 upper gasket
32 stem aperture
34 lower aperture
36 upper aperture
38 air space
40 control means

DESCRIPTION OF THE PREFERRED EMBODIMENT(S)

Figure 2:
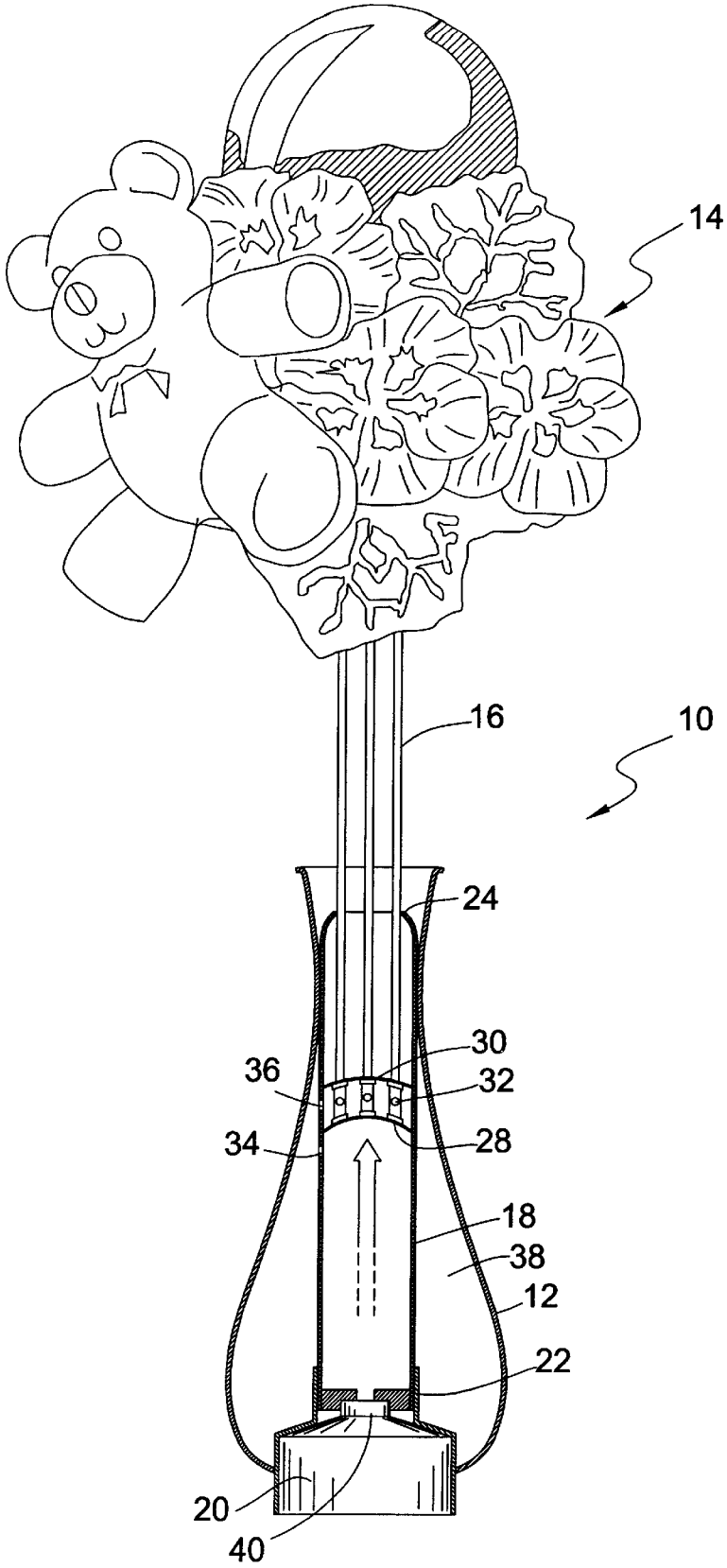
FIG. 2 is a perspective view of the present invention in an inflated position.

Turning now descriptively to the drawings, in which similar reference characters denote similar elements throughout the several views, FIGS. 1 through 2 illustrate the present invention wherein an inflatable balloon bouquet is disclosed.

Turning to FIG. 1, therein is shown a perspective view of the present invention in the early stages of inflation. Shown therein is a flower vase 12 containing a balloon bouquet 14 in an uninflated condition being connected or disposed in a tight ball on the upper part of elongated hollow stems 16. Internal of vase 12 is an air shaft or cylinder 18 disposed lengthwise in the vase 12. At the base of the air shaft 18 there is an air canister 20 having means for secure connection 22 to the lower end of the airshaft. The airshaft 18 gradually tapers, i.e., its diameter becomes smaller, toward its upper end with upper seal means 24 being provided by the upper gasket 30. The lower ends of the stems 16 have lower 28 and upper 30 rubber sealing gaskets with apertures 26 therethrough provided for the lower ends of the stems. Rubber gaskets 28, 30 are complementary shaped as the air cylinder 18 so that an effectively tight seal is formed therebetween. Also shown are apertures 32 into the lower ends of stems 16. Also shown in the wall of the air cylinder are a lower aperture 34 and upper aperture 36 which will be further explained hereinafter.

Turning to FIG. 2, therein is shown a perspective view of the present invention 10 showing the present invention in a fully inflated condition. Shown therein is a flower vase 12 containing a balloon bouquet 14 in an inflated condition being connected or disposed on the upper part of elongated stems 16. Internal of vase 12 is an air shaft or cylinder 18 disposed lengthwise in the vase 12. At the base of the air shaft 18 there is an air canister 20 having means for connection 22 to the lower end of the airshaft. The airshaft is tapered at its upper end 24. The lower ends of the stems 16 have lower 28 and upper 30 rubber gaskets provided for the lower ends of the stems. Rubber gaskets 28, 30 are complementary shaped as the air cylinder. Also shown are apertures 32 into the stems 16. Also shown in the wall of the air cylinder are a lower aperture 34 and upper aperture 36 which will be further explained hereinafter.

In operation, it can be seen that as the gas expands it pushes the lower rubber gasket 28 above the lower aperture 34 of the air cylinder 18. The air then flows through the lower aperture 34 into the air space 38 in the body of the vase 12 and back through the upper aperture 36 in the air cylinder and thereafter it flows into the stem apertures 32 located in the bottom of the stems and then through the hollow bore of the stems into the balloons. The balloons are thereby inflated. The volume of the gas canisters is matched in production to the volume of the balloons so that the gas flow stops as the balloons reach their proper and full inflation. The weight of the empty canister 20 provides stability and weight to the bottom of the vase 12. Control means 40 will also be provided in order to actuate and open the air canister 20 so as to release the gas contained therein.

The balloons 14 can either be made from rubber, metalized plastic, or other suitable material as would be done by one skilled in the art. The gas canister 20 can use either pressurized gas or a chemical mixture that creates gas when the user adds water. When the present invention 10 is shipped in the uninflated condition, the balloons 14 are packed into tight balls and nested in the neck of the vase 12.

Many specific details contained in the above description merely illustrate some preferred embodiments and should not be construed as a limitation on the scope of the invention. Many other variations are possible.

What is claimed to be new and desired to be protected by Letters Patent is set forth in the appended claims:

1. An apparatus for providing an inflatable balloon bouquet, comprising:

a) a vase, said vase having an upper end and a base;

b) means for an air supply disposed in the base of said vase;

c) an air shaft centrally disposed lengthwise within said vase, said air shaft having an upper end and a lower end, said air shaft forming an air space between its wall and the wall of said vase;

d) means for connecting said airshaft to said means for an air supply;

e) means for a lower and an upper seal being slidably disposed in said air shaft;

f) a plurality of stems disposed within said air shaft, said stems having an upper end and a lower end, said stems having a bore therein, wherein said means for a lower and an upper seal are disposed on said lower end of said plurality of stems;

g) an inflatable bouquet disposed on said upper end of said stems, said bouquet being uninflated; and, h) means for inflating said inflatable bouquet whereby an inflated balloon bouquet is provided.

2. The apparatus of claim 1, wherein said means for an air supply further comprises a canister, said canister containing compressed gas.

3. The apparatus of claim 2, wherein said air shaft is tapered, said air shaft having a smaller diameter on said upper end than on said lower end.

4. The apparatus of claim 3, wherein said means for forming a lower and an upper seal each further comprises a seal, each of said seals having a plurality of apertures therein for receiving said plurality of stems.

5. The apparatus of claim 4, wherein the wall of said airshaft has a first lower aperture therein and a second upper aperture therein.

6. The apparatus of claim 5, wherein said lower end of said stems have an aperture therein, said aperture disposed in the wall of said stems.

7. The apparatus of claim 6, wherein said means for inflating said bouquet further comprises said a lower seal and said upper seal disposed on said lower end of said stems, said lower and upper seals being complementarily shaped as said air shaft, said lower seal being disposed below said stem aperture and said upper seal being disposed above said stem aperture, said upper seal and said lower seal being slidable within said air shaft.

8. The apparatus of claim 7, wherein said lower seal and said upper seal have a plurality of apertures therein, said apertures for receiving said plurality of stems.

9. The apparatus of claim 8, wherein said upper end of said air shaft is sized to fixedly secure said upper seal and said lower seal so that said lower seal is disposed between said first lower aperture and said second upper aperture of said air shaft wall so that air will pass through said first lower aperture of said air shaft wall, through said air space into said second upper aperture of said air shaft, into said apertures on said lower end of said stems, and thereafter into said bouquet.

10. The apparatus of claim 9, wherein said bouquet comprises rubber.

11. The apparatus of claim 9, wherein said bouquet comprises metalized plastic.

12. The apparatus of claim 9, wherein said means for an air supply is volumetrically sized to provide sufficient air to properly inflate said bouquet.

13. The apparatus of claim 12, wherein said means for an air supply has a control means disposed thereon whereby said air supply can be controlled.

* * * * *